US010645520B1

(12) United States Patent
Amengual Gari et al.

(10) Patent No.: US 10,645,520 B1
(45) Date of Patent: May 5, 2020

(54) AUDIO SYSTEM FOR ARTIFICIAL REALITY ENVIRONMENT

(71) Applicant: Facebook Technologies, LLC, Menlo Park, CA (US)

(72) Inventors: Sebastiá Vicenç Amengual Gari, Seattle, WA (US); Carl Schissler, Redmond, WA (US); Peter Henry Maresh, Seattle, WA (US); Andrew Lovitt, Redmond, WA (US); Philip Robinson, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/450,678

(22) Filed: Jun. 24, 2019

(51) Int. Cl.

| | |
|---|---|
| ***H04R 3/00*** | (2006.01) |
| ***H04S 7/00*** | (2006.01) |
| ***H04R 5/033*** | (2006.01) |
| ***H04R 5/04*** | (2006.01) |
| ***G10L 21/0232*** | (2013.01) |
| ***H04R 3/04*** | (2006.01) |
| ***H04S 3/00*** | (2006.01) |

(52) U.S. Cl.
CPC ..... *H04S 7/304* (2013.01); *G10L 21/0232* (2013.01); *H04R 3/04* (2013.01); *H04R 5/033* (2013.01); *H04R 5/04* (2013.01); *H04S 3/008* (2013.01); *H04S 7/306* (2013.01); *H04S 2400/01* (2013.01); *H04S 2400/15* (2013.01); *H04S 2420/01* (2013.01)

(58) Field of Classification Search
CPC . H04R 3/00; H04R 3/005; H04R 3/04; H04R 3/12; H04R 5/00; H04R 5/04; H04R 5/033; H04S 7/30; H04S 7/305; H04S 7/306; H04S 3/008; H04S 2400/01; H04S 2400/15; H04S 2420/01; G10L 21/0232
See application file for complete search history.

(56) References Cited

U.S. PATENT DOCUMENTS

| | | | | |
|---|---|---|---|---|
| 7,917,236 | B1 * | 3/2011 | Yamada | G10K 15/02 381/18 |
| 2008/0227407 | A1 * | 9/2008 | Erb | H04M 19/04 455/77 |
| 2011/0091042 | A1 * | 4/2011 | Ko | H04R 5/02 381/17 |
| 2013/0094668 | A1 * | 4/2013 | Poulsen | H03G 3/301 381/107 |
| 2015/0341734 | A1 * | 11/2015 | Sherman | G10K 11/341 381/92 |

(Continued)

*Primary Examiner* — Thang V Tran
(74) *Attorney, Agent, or Firm* — Fenwick & West LLP

(57) ABSTRACT

An audio system on a headset presents, to a user, audio content simulating a target artificial reality environment. The system receives audio content from an environment and analyzes the audio content to determine a set of acoustic properties associated with the environment. The audio content may be user generated or ambient sound. After receiving a set of target acoustic properties for a target environment, the system determines a transfer function by comparing the set of acoustic properties and the target environment's acoustic properties. The system adjusts the audio content based on the transfer function and presents the adjusted audio content to the user. The presented adjusted audio content includes one or more of the target acoustic properties for the target environment.

20 Claims, 5 Drawing Sheets

(56) References Cited

U.S. PATENT DOCUMENTS

| | | | | |
|---|---|---|---|---|
| 2017/0339504 | A1* | 11/2017 | Bharitkar | H04S 3/004 |
| 2018/0167760 | A1* | 6/2018 | Yu | H04N 21/4305 |
| 2018/0227687 | A1* | 8/2018 | Thomson | H04R 29/004 |
| 2018/0317037 | A1* | 11/2018 | Brannmark | H04S 1/002 |
| 2019/0103848 | A1* | 4/2019 | Shaya | H04R 29/001 |
| 2019/0124461 | A1* | 4/2019 | Christoph | H03G 5/005 |
| 2019/0394564 | A1* | 12/2019 | Mehra | H04R 1/406 |

* cited by examiner

AUDIO SYSTEM FOR ARTIFICIAL REALITY ENVIRONMENT

BACKGROUND

The present disclosure generally relates to audio systems, and specifically relates to an audio system that renders sound for a target artificial reality environment.

Head mounted displays (HMDs) may be used to present virtual and/or augmented information to a user. For example, an augmented reality (AR) headset or a virtual reality (VR) headset can be used to simulate an augmented/virtual reality. Conventionally, a user of the AR/VR headset wears headphones to receive, or otherwise experience, computer generated sounds. The environments in which the user wears the AR/VR headset often do not match the virtual spaces that the AR/VR headset simulates, thus presenting auditory conflicts for the user. For instance, musicians and actors generally need to complete rehearsals in a performance space, as their playing style and the sound received at the audience area depends on the acoustics of the hall. In addition, in games or applications which involve user generated sounds e.g. speech, handclaps, and so forth, the acoustic properties of the real space where players are do not match those of the virtual space.

SUMMARY

A method for rendering sound in a target artificial reality environment is disclosed. The method analyzes, via a controller, a set of acoustic properties associated with an environment. The environment may be a room that a user is located in. One or more sensors receive audio content from within the environment, including user generated and ambient sound. For example, a user may speak, play an instrument, or sing in the environment, while ambient sound may include a fan running and dog barking, among others. In response to receiving a selection of a target artificial reality environment, such as a stadium, concert hall, or field, the controller compares the acoustic properties of the room the user is currently in with a set of target acoustic properties, associated with the target environment. The controller subsequently determines a transfer function, which it uses to adjust the received audio content. Accordingly, one or more speakers present the adjusted audio content for the user such that the adjusted audio content includes one or more of the target acoustic properties for the target environment. The user perceives the adjusted audio content as though they were in the target environment.

In some embodiments, the method is performed by an audio system that is part of a headset (e.g., near eye display (NED), head mounted display (HMD)). The audio system includes the one or more sensors to detect audio content, the one or more speakers to present adjusted audio content, and the controller to analyze the environment's acoustic properties with the target environment's acoustic properties, as well as to determine a transfer function characterizing the comparison of the two sets of acoustic properties.

Figure 1:
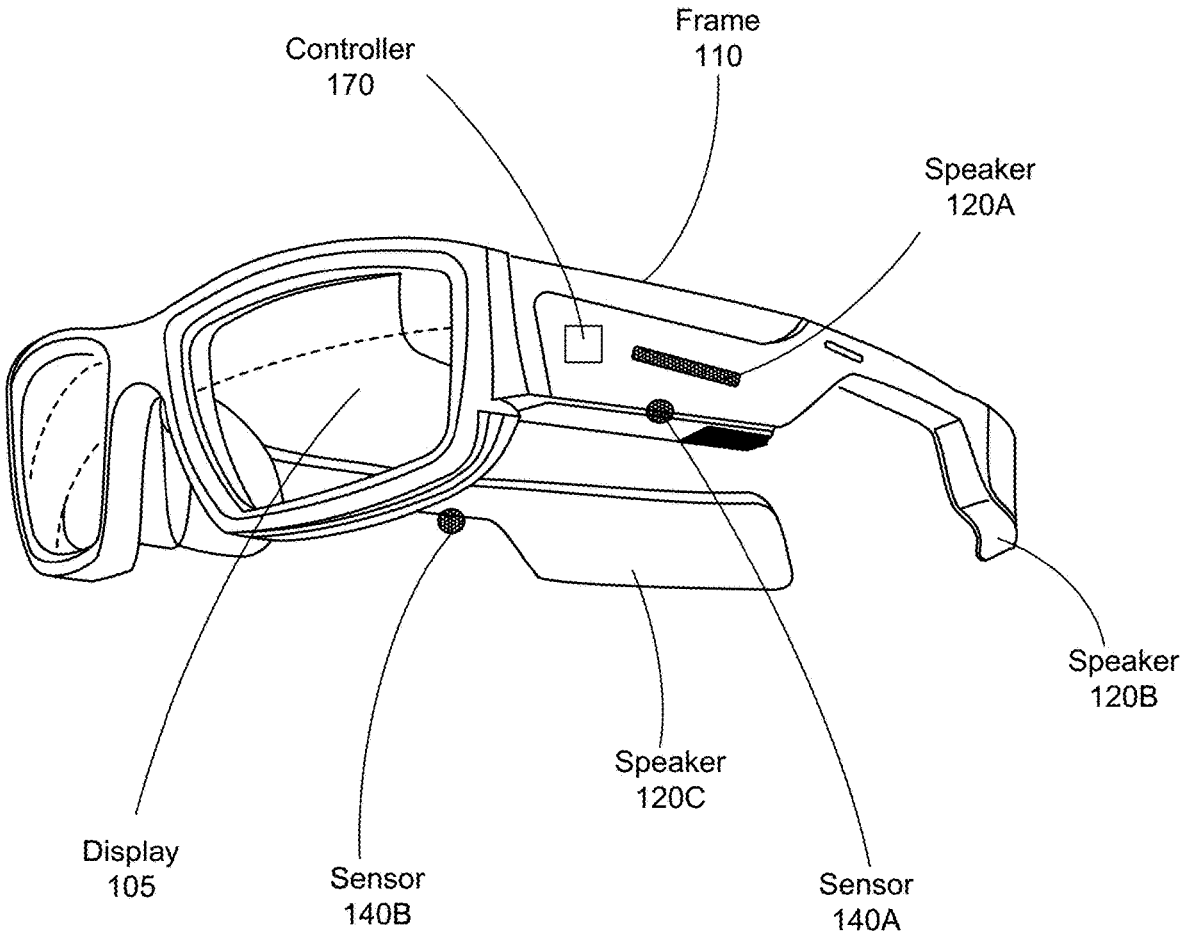
FIG. 1 is a diagram of a headset, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An audio system renders audio content for a target artificial reality environment. While wearing an artificial reality (AR) or virtual reality (VR) device, such as a headset, a user may generate audio content (e.g., speech, music from an instrument, clapping, or other noise). The acoustic properties of the user's current environment, such as a room, may not match the acoustic properties of the virtual space, i.e., the target artificial reality environment, simulated by the AR/VR headset. The audio system renders user generated audio content as though it were generated in the target environment, while accounting for ambient sound in the user's current environment as well. For example, the user may use the headset to simulate a vocal performance in a concert hall, i.e., the target environment. When the user sings, the audio system adjusts the audio content, i.e., the sound of the user singing, such that it sounds like the user is singing in the concert hall. Ambient noise in the environment around the user, such as water dripping, people talking, or a fan running, may be attenuated, since it is unlikely the target environment features those sounds. The audio system accounts for ambient sound and user generated sounds that are uncharacteristic of the target environment, and renders audio content such that it sounds to have been produced in the target artificial reality environment.

The audio system includes one or more sensors to receive audio content, including sound generated by the user, as well as ambient sound around the user. In some embodiments, the audio content may be generated by more than one user in the environment. The audio system analyzes a set of acoustic properties of the user's current environment. The audio system receives the user selection of the target environment. After comparing an original response associated with the current environment's acoustic properties and a target response associated with the target environment's acoustic properties, the audio system determines a transfer function. The audio system adjusts the detected audio content as per the determined transfer function, and presents the adjusted audio content for the user via one or more speakers.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

System Overview

FIG. 1 is a diagram of a headset 100, in accordance with one or more embodiments. The headset 100 presents media to a user. The headset 100 includes an audio system, a display 105, and a frame 110. In general, the headset may be worn on the face of a user such that content is presented using the headset. Content may include audio and visual media content that is presented via the audio system and the display 105, respectively. In some embodiments, the headset may only present audio content via the headset to the user. The frame 110 enables the headset 100 to be worn on the user's face and houses the components of the audio system. In one embodiment, the headset 100 may be a head mounted display (HMD). In another embodiment, the headset 100 may be a near eye display (NED).

The display 105 presents visual content to the user of the headset 100. The visual content may be part of a virtual reality environment. In some embodiments, the display 105 may be an electronic display element, such as a liquid crystal display (LCD), an organic light emitting diode (OLED) display, a quantum organic light emitting diode (QOLED) display, a transparent organic light emitting diode (TOLED) display, some other display, or some combination thereof. The display 105 may be backlit. In some embodiments, the display 105 may include one or more lenses, which augment what the user sees while wearing the headset 100.

The audio system presents audio content to the user of the headset 100. The audio system includes, among other components, one or more sensors 140A, 140B, one or more speakers 120A, 120B, 120C, and a controller. The audio system may provide adjusted audio content to the user, rendering detected audio content as though it is being produced in a target environment. For example, the user of the headset 100 may want to practice playing an instrument in a concert hall. The headset 100 would present visual content simulating the target environment, i.e., the concert hall, as well as audio content simulating how sounds in the target environment will be perceived by the user. Additional details regarding the audio system are discussed below with regard to FIGS. 2-5.

The speakers 120A, 120B, and 120C generate acoustic pressure waves to present to the user, in accordance with instructions from the controller 170. The speakers 120A, 120B, and 120C may be configured to present adjusted audio content to the user, wherein the adjusted audio content includes at least some of the acoustic properties of the target environment. The one or more speakers may generate the acoustic pressure waves via air conduction, transmitting the airborne sound to an ear of the user. In some embodiments, the speakers may present content via tissue conduction, in which the speakers may be transducers that directly vibrate tissue (e.g., bone, skin, cartilage, etc.) to generate an acoustic pressure wave. For example, the speakers 120B and 120C may couple to and vibrate tissue near and/or at the ear, to produce tissue borne acoustic pressure waves detected by a cochlea of the user's ear as sound. The speakers 120A, 120B, 120C may cover different parts of a frequency range. For example, a piezoelectric transducer may be used to cover a first part of a frequency range and a moving coil transducer may be used to cover a second part of a frequency range.

The sensors 140A, 140B monitor and capture data about audio content from within a current environment of the user. The audio content may include user generated sounds, including the user speaking, playing an instrument, and singing, as well as ambient sound, such as a dog panting, an air conditioner running, and water running. The sensors 140A, 140B may include, for example, microphones, accelerometers, other acoustic sensors, or some combination thereof.

In some embodiments, the speakers 120A, 120B, and 120C and the sensors 140A and 140B may be positioned in different locations within and/or on the frame 110 than presented in FIG. 1. The headset may include speakers and/or sensors varying in number and/or type than what is shown in FIG. 1.

The controller 170 instructs the speakers to present audio content and determines a transfer function between the user's current environment and a target environment. An environment is associated with a set of acoustic properties. An acoustic property characterizes how an environment responds to acoustic content, such as the propagation and reflection of sound through the environment. An acoustic property may be reverberation time from a sound source to the headset 100 for a plurality of frequency bands, a reverberant level for each of the frequency bands, a direct to reverberant ratio for each frequency band, a time of early reflection of a sound from the sound source to the headset 100, other acoustic properties, or some combination thereof. For example, the acoustic properties may include reflections of a signal off of surfaces within a room, and the decay of the signal as it travels through the air.

A user may simulate a target artificial reality environment, i.e., a "target environment," using the headset 100. The user located in a current environment, such as a room, may choose to simulate a target environment. The user may select a target environment from a plurality of possible target environment options. For example, the user may select a stadium, from a list of choices that include an opera hall, an indoor basketball court, a music recording studio, and others. The target environment has its own set of acoustic properties, i.e., a set of target acoustic properties, that characterize how sound is perceived in the target environment. The controller 170 determines an "original response," a room impulse response of the user's current environment, based on the current environment's set of acoustic properties. The original response characterizes how the user perceives sound in their current environment, i.e., the room, at a first position. In some embodiments, the controller 170 may determine an original response at a second position of the user. For example, the sound perceived by the user at the center of the room will be different from the sound perceived at the entrance to the room. Accordingly, the original response at the first position (e.g., the center of the room) will vary from that at the second position (e.g., the entrance to the room). The controller 170 also determines a "target response," characterizing how sound will be perceived at the target environment, based on the target acoustic properties. Comparing the original response and the target response, the controller 170 determines a transfer function that it uses in adjusting audio content. In comparing the original response and the target response, the controller 170 determines the differences between acoustic parameters in the user's current environment and those in the target environment. In some cases, the difference may be negative, in which case the controller 170 cancels and/or occludes sounds from the current environment of the user to achieve sounds in the target environment. In other cases, the difference may be additive, wherein the controller 170 adds and/or enhances certain sounds to portray sounds in the target environment. The controller 170 may use sound filters to alter the sounds in the current environment to achieve the sounds in the target environment, which is described in further detail below with respect to FIG. 3. The controller 170 may measure differences between sound in the current environment and the target environment by determining differences in environmental parameters that affect the sound in the environments. For example, the controller 170 may compare the temperatures and relative humidity of the environments, in addition to comparisons of acoustic parameters such as reverberation and attenuation. In some embodiments, the transfer function is specific to the user's position in the environment, e.g., the first or second position. The adjusted audio content reflects at least a few of the target acoustic properties, such that the user perceives the sound as though it were being produced in the target environment.

Rendering Sound for a Target Environment

Figure 2A:
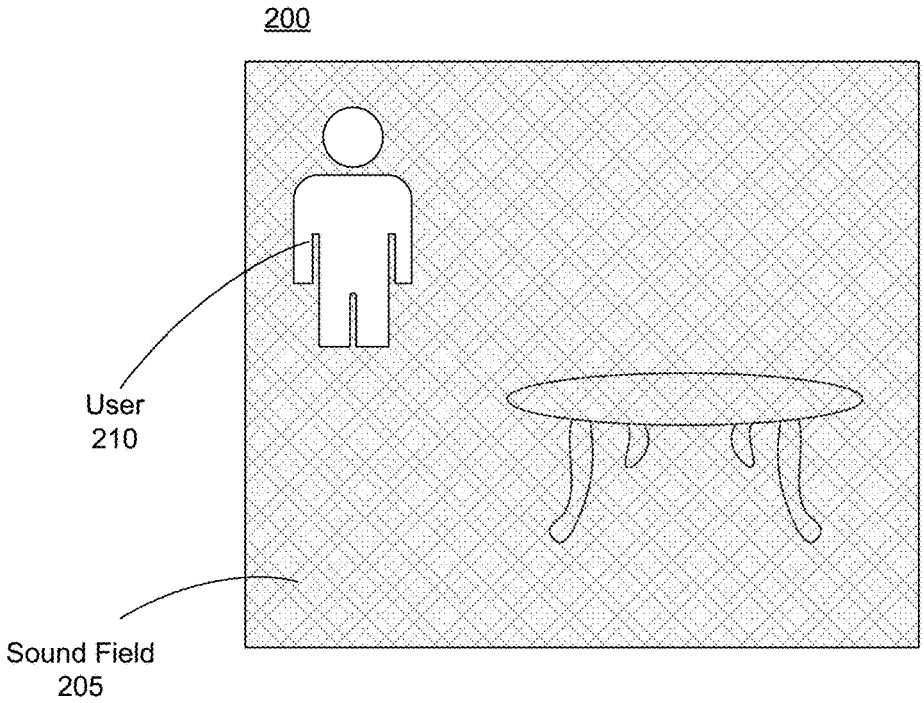
FIG. 2A illustrates a sound field, in accordance with one or more embodiments.

FIG. 2A illustrates a sound field, in accordance with one or more embodiments. A user 210 is located in an environment 200, such as a living room. The environment 200 has a sound field 205, including ambient noise and user generated sound. Sources of ambient noise may include, for example, traffic on a nearby street, a neighbor's dog barking, and someone else typing on a keyboard in an adjacent room. The user 210 may generate sounds such as singing, playing the guitar, stomping their feet, and speaking. In some embodiments, the environment 200 may include a plurality of users who generate sound. Prior to wearing an artificial reality (AR) and/or virtual reality (VR) headset (e.g., the headset 100), the user 210 may perceive sound as per a set of acoustic properties of the environment 200. For example, in the living room, perhaps filled with many objects, the user 210 may perceive minimal echo when they speak.

Figure 2B:
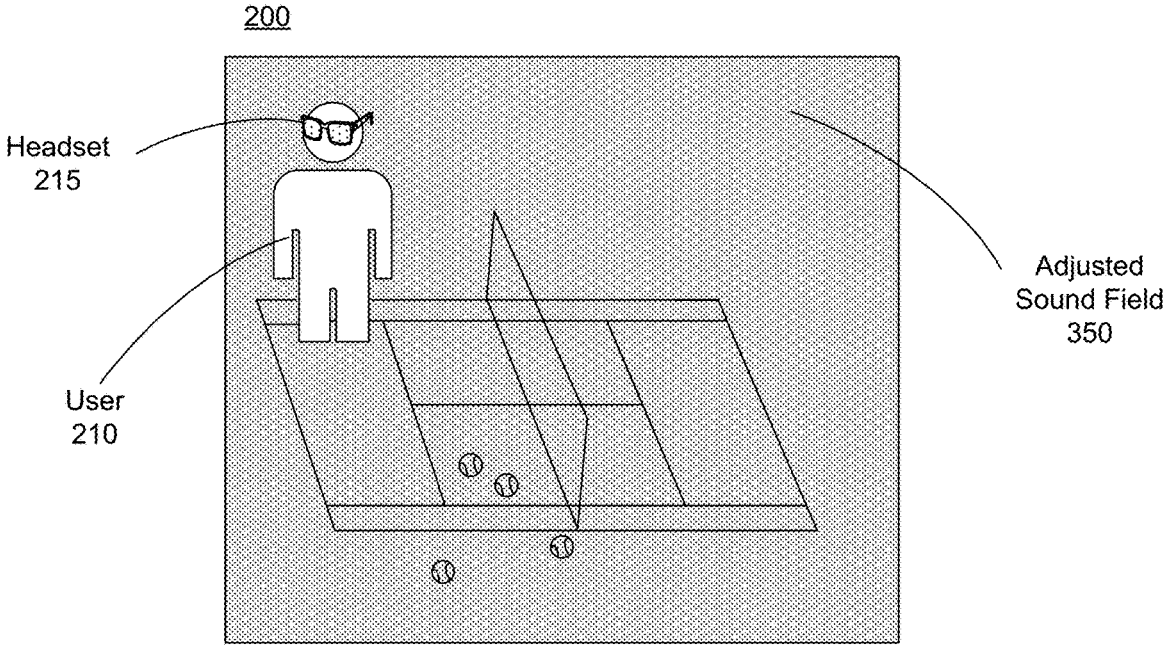
FIG. 2B illustrates the sound field after rendering audio content for a target environment, in accordance with one or more embodiments.

FIG. 2B illustrates the sound field after rendering audio content for a target environment, in accordance with one or more embodiments. The user 210 is still located in the environment 200 and wears a headset 215. The headset 215 is an embodiment of the headset 100 described in FIG. 1, which renders audio content such that the user 210 perceives an adjusted sound field 350.

The headset 215 detects audio content in the environment of the user 210 and presents adjusted audio content to the user 210. As described above, with respect to FIG. 1, the headset 215 includes an audio system with at least one or more sensors (e.g., the sensors 140A, 140B), one or more speakers (e.g., the speakers 120A, 120B, 120C), and a controller (e.g., the controller 170). The audio content in the environment 200 of the user 210 may be generated by the user 210, other users in the environment 200, and/or ambient sound.

The controller identifies and analyzes a set of acoustic properties associated with the environment 200, by estimating a room impulse response that characterizes the user 210's perception of a sound made within the environment 200. The room impulse response is associated with the user 210's perception of sound at a particular position in the environment 200, and will change if the user 210 changes location within the environment 200. The room impulse response may be generated by the user 210, before the headset 215 renders content for an AR/VR simulation. The user 210 may generate a test signal, using a mobile device for example, in response to which the controller measures the impulse response. Alternatively, the user 210 may generate impulsive noise, such as hand claps, to generate an impulse signal the controller measures. In another embodiment, the headset 215 may include image sensors, such as cameras, to record image and depth data associated with the environment 200. The controller may use the sensor data and machine learning to simulate the dimensions, lay out, and parameters of the environment 200. Accordingly, the controller may learn the acoustic properties of the environment 200, thereby obtaining an impulse response. The controller uses the room impulse response to define an original response, characterizing the acoustic properties of the environment 200 prior to audio content adjustment. Estimating a room's acoustic properties is described in further detail in U.S. patent application Ser. No. 16/180,165 filed on Nov. 5, 2018, incorporated herein by reference in its entirety.

In another embodiment, the controller may provide a mapping server with visual information detected by the headset 215, wherein the visual information describes at least a portion of the environment 200. The mapping server may include a database of environments and their associated acoustic properties, and can determine, based on the received visual information, the set of acoustic properties associated with the environment 200. In another embodiment, the controller may query the mapping server with location information, in response to which the mapping server may retrieve the acoustic properties of an environment associated with the location information. The use of a mapping server in an artificial reality system environment is discussed in further detail with respect to FIG. 5.

The user 210 may specify a target artificial reality environment for rendering sound. The user 210 may select the target environment via an application on the mobile device, for example. In another embodiment, the headset 215 may be previously programmed to render a set of target environments. In another embodiment, the headset 215 may connect to the mapping server that includes a database that lists available target environments and associated target acoustic properties. The database may include real-time simulations of the target environment, data on measured impulse responses in the target environments, or algorithmic reverberation approaches.

The controller of the headset 215 uses the acoustic properties of the target environment to determine a target response, subsequently comparing the target response and original response to determine a transfer function. The original response characterizes the acoustic properties of the user's current environment, while the target response characterizes the acoustic properties of the target environment. The acoustic properties include reflections within the environments from various directions, with particular timing and amplitude. The controller uses the differences between the reflections in the current environment and reflections in the target environment to generate a difference reflection pattern, characterized by the transfer function. From the transfer function, the controller can determine the head related transfer functions (HRTF) needed to convert sound produced in the environment 200 to what it would be perceived in the target environment. HRTFs characterize how an ear of the user receives a sound from a point in space and vary depending on the user's current head position. The controller applies a HRTF corresponding to a reflection direction at the timing and amplitude of the reflection to generate a corresponding target reflection. The controller repeats this process in real time for all difference reflections, such that the user perceives sound as though it has been produced in the target environment. HRTFs are described in detail in U.S. patent application Ser. No. 16/390,918 filed on Apr. 22, 2019, incorporated herein by reference in its entirety.

After wearing the headset 215, the user 210 may produce some audio content, detected by the sensors on the headset 215. For example, the user 210 may stomp their feet on the ground, physically located in the environment 200. The user 210 selects a target environment, such as an indoor tennis court depicted by FIG. 2B, for which the controller determines a target response. The controller 210 determines the transfer function for the specified target environment. The headset 215's controller convolves, in real time, the transfer function with the sound produced within the environment 200, such as the stomping of the user 210's feet. The convolution adjusts the audio content's acoustic properties based on the target acoustic properties, resulting in adjusted audio content. The headset 215's speakers present the adjusted audio content, which now includes one or more acoustic properties of the target acoustic properties, to the user. Ambient sound in the environment 200 that is not featured in the target environment is dampened, so the user 210 does not perceive them. For example, the sound of a dog barking in the sound field 205 would not be present in the adjusted audio content, presented via the adjusted sound field 350. The user 210 would perceive the sound of their stomping feet as though they were in the target environment of the indoor tennis court, which may not include a dog barking.

Figure 3:
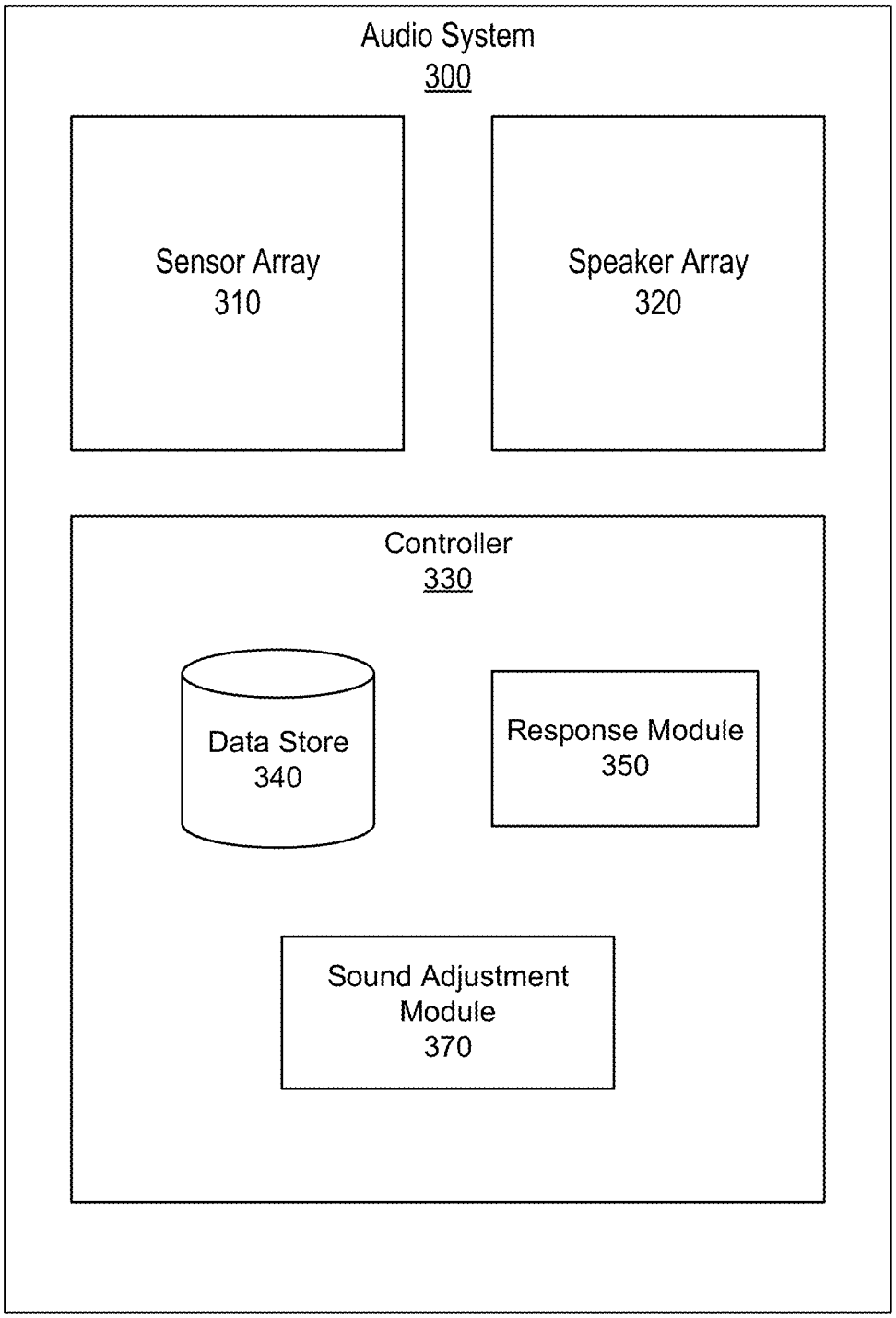
FIG. 3 is a block diagram of an example audio system, in accordance with one or more embodiments.

FIG. 3 is a block diagram of an example audio system, in accordance with one or more embodiments. The audio system 300 may be a component of a headset (e.g., the headset 100) that provides audio content to a user. The audio system 300 includes a sensor array 310, a speaker array 320, and a controller 330 (e.g., the controller 170). The audio systems described in FIGS. 1-2 are embodiments of the audio system 300. Some embodiments of the audio system 300 include other components than those described herein. Similarly, the functions of the components may be distributed differently than described here. For example, in one embodiment, the controller 330 may be external to the headset, rather than embedded within the headset.

The sensor array 310 detects audio content from within an environment. The sensor array 310 includes a plurality of sensors, such as the sensors 140A and 140B. The sensors may be acoustic sensors, configured to detect acoustic pressure waves, such as microphones, vibration sensors, accelerometers, or any combination thereof. The sensor array 410 is configured to monitor a sound field within an environment, such as the sound field 205 in the room 200. In one embodiment, the sensor array 310 converts the detected acoustic pressure waves into an electric format (analog or digital), which it then sends to the controller 330. The sensor array 310 detects user generated sounds, such as the user speaking, singing, or playing an instrument, along with ambient sound, such as a fan running, water dripping, or a dog barking. The sensor array 310 distinguishes between the user generated sound and ambient noise by tracking the source of sound, and stores the audio content accordingly in the data store 340 of the controller 330. The sensor array 310 may perform positional tracking of a source of the audio content within the environment by direction of arrival (DOA) analysis, video tracking, computer vision, or any combination thereof. The sensor array 310 may use beamforming techniques to detect the audio content. In some embodiments, the sensor array 310 includes sensors other than those for detecting acoustic pressure waves. For example, the sensor array 310 may include image sensors, inertial measurement units (IMUs), gyroscopes, position sensors, or a combination thereof. The image sensors may be cameras configured to perform the video tracking and/or communicate with the controller 330 for computer vision. Beamforming and DOA analysis are further described in detail in U.S. patent application Ser. No. 16/379,450 filed on Apr. 9, 2019 and Ser. No. 16/016,156 filed on Jun. 22, 2018, incorporated herein by reference in their entirety.

The speaker array 320 presents audio content to the user. The speaker array 320 comprises a plurality of speakers, such as the speakers 120A, 120B, 120C in FIG. 1. The speakers in the speaker array 320 are transducers that transmit acoustic pressure waves to an ear of the user wearing the headset. The transducers may transmit audio content via air conduction, in which airborne acoustic pressure waves reach a cochlea of the user's ear and are perceived by the user as sound. The transducers may also transmit audio content via tissue conduction, such as bone conduction, cartilage conduction, or some combination thereof. The speakers in the speaker array 320 may be configured to provide sound to the user over a total range of frequencies. For example, the total range of frequencies is 20 Hz to 20 kHz, generally around the average range of human hearing. The speakers are configured to transmit audio content over various ranges of frequencies. In one embodiment, each speaker in the speaker array 320 operates over the total range of frequencies. In another embodiment, one or more speakers operate over a low subrange (e.g., 20 Hz to 500 Hz), while a second set of speakers operates over a high subrange (e.g., 500 Hz to 20 kHz). The subranges for the speakers may partially overlap with one or more other subranges.

The controller 330 controls the operation of the audio system 300. The controller 330 is substantially similar to the controller 170. In some embodiments, the controller 330 is configured to adjust audio content detected by the sensor array 310 and instruct the speaker array 320 to present the adjusted audio content. The controller 330 includes a data store 340, a response module 350, and a sound adjustment module 370. The controller 330 may query a mapping server, further described with respect to FIG. 5, for acoustic properties of the user's current environment and/or acoustic properties of the target environment. The controller 330 may be located inside the headset, in some embodiments. Some embodiments of the controller 330 have different components than those described here. Similarly, functions can be distributed among the components in different manners than described here. For example, some functions of the controller 330 may be performed external to the headset.

The data store 340 stores data for use by the audio system 300. Data in the data store 340 may include a plurality of target environments that the user can select, sets of acoustic properties associated with the target environments, the user selected target environment, measured impulse responses in the user's current environment, head related transfer functions (HRTFs), sound filters, and other data relevant for use by the audio system 300, or any combination thereof.

The response module 350 determines impulse responses and transfer functions based on the acoustic properties of an environment. The response module 350 determines an original response characterizing the acoustic properties of the user's current environment (e.g., the environment 200), by estimating an impulse response to an impulsive sound. For example, the response module 350 may use an impulse response to a single drum beat in a room the user is in to determine the acoustic parameters of the room. The impulse response is associated with a first position of the sound source, which may be determined by DOA and beam forming analysis by the sensor array 310 as described above. The impulse response may change as the sound source and the position of the sound source changes. For example, the acoustic properties of the room the user in may differ at the center and at the periphery. The response module 350 accesses the list of target environment options and their target responses, which characterize their associated acoustic properties, from the data store 340. Subsequently, the response module 350 determines a transfer function that characterizes the target response as compared to the original response. The original response, target response, and transfer function are all stored in the data store 340. The transfer function may be unique to a specific sound source, position of the sound source, the user, and target environment.

The sound adjustment module 370 adjusts sound as per the transfer function and instructs the speaker array 320 to play the adjusted sound accordingly. The sound adjustment module 370 convolves the transfer function for a particular target environment, stored in the data store 340, with the audio content detected by the sensor array 310. The convolution results in an adjustment of the detected audio content based on the acoustic properties of the target environment, wherein the adjusted audio content has at least some of the target acoustic properties. The convolved audio content is stored in the data store 340. In some embodiments, the sound adjustment module 370 generates sound filters based in part on the convolved audio content, and then instructs the speaker array 320 to present adjusted audio content accordingly. In some embodiments, the sound adjustment module 370 accounts for the target environment when generating the sound filters. For example, in a target environment in which all other sound sources are quiet except for the user generated sound, such as a classroom, the sound filters may attenuate ambient acoustic pressure waves while amplifying the user generated sound. In a loud target environment, such as a busy street, the sound filters may amplify and/or augment acoustic pressure waves that match the acoustic properties of the busy street. In other embodiments, the sound filters may target specific frequency ranges, via low pass filters, high pass filters, and band pass filters. Alternatively, the sound filters may augment detected audio content to reflect that in the target environment. The generated sound filters are stored in the data store 340.

Figure 4:
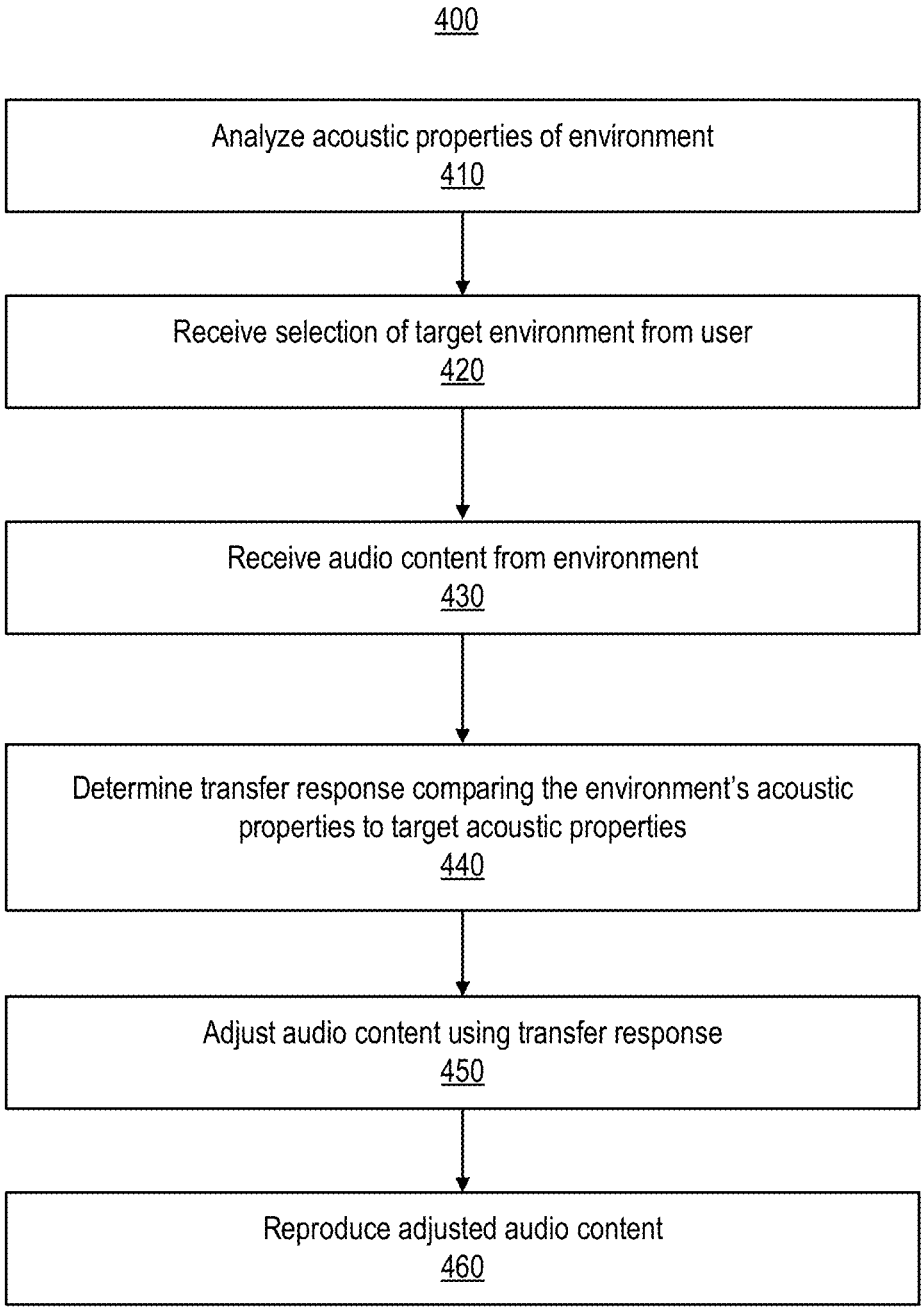
FIG. 4 is a process for rendering audio content for a target environment, in accordance with one or more embodiments.

FIG. 4 is a process 400 for rendering audio content for a target environment, in accordance with one or more embodiments. An audio system, such as the audio system 300, performs the process. The process 400 of FIG. 4 may be performed by the components of an apparatus, e.g., the audio system 300 of FIG. 3. Other entities (e.g., components of the headset 100 of FIG. 1 and/or components shown in FIG. 5) may perform some or all of the steps of the process in other embodiments. Likewise, embodiments may include different and/or additional steps, or perform the steps in different orders.

The audio system analyzes 410 a set of acoustic properties of an environment, such as a room the user is in. As described above, with respect to FIGS. 1-3, an environment has a set of acoustic properties associated with it. The audio system identifies the acoustic properties by estimating an impulse response in the environment at a user's position within the environment. The audio system may estimate the impulse response in the user's current environment by running a controlled measurement using a mobile device generated audio test signal or user generated impulsive audio signals, such as hand claps. For example, in one embodiment, the audio system may use measurements of the room's reverberation time to estimate the impulse response. Alternatively, the audio system may use sensor data and machine learning to determine room parameters and determine the impulse response accordingly. The impulse response in the user's current environment is stored as an original response.

The audio system receives 420 a selection of a target environment from the user. The audio system may present the user with a database of available target environment options, allowing the user to select a specific room, hall, stadium, and so forth. In one embodiment, the target environment may be determined by a game engine according to a game scenario, such as the user entering a large quiet church with marble floors. Each of the target environment options is associated with a set of target acoustic properties, which also may be stored with the database of available target environment options. For example, the target acoustic properties of the quiet church with marble floors may include echo. The audio system characterizes the target acoustic properties by determining a target response.

The audio system receives 430 audio content from the user's environment. The audio content may be generated by a user of the audio system or ambient noise in the environment. A sensor array within the audio system detects the sound. As described above, the one or more sources of interest, such as the user's mouth, musical instrument, etc. can be tracked using DOA estimation, video tracking, beamforming, and so forth.

The audio system determines 440 a transfer function by comparing the acoustic properties of the user's current environment to those of the target environment. The current environment's acoustic properties are characterized by the original response, while those of the target environment are characterized by the target response. The transfer function can be generated using real-time simulations, a database of measured responses, or algorithmic reverb approaches. Accordingly, the audio system adjusts 450 the detected audio content based on the target acoustic properties of the target environment. In one embodiment, as described in FIG. 3, the audio system convolves the transfer function with the audio content to generate a convolved audio signal. The audio system may make use of sound filters to amplify, attenuate, or augment the detected sound.

The audio system presents 460 the adjusted audio content and presents it to the user via a speaker array. The adjusted audio content has at least some of the target acoustic properties, such that the user perceives the sound as though they are located in the target environment.

Example of an Artificial Reality System

Figure 5:
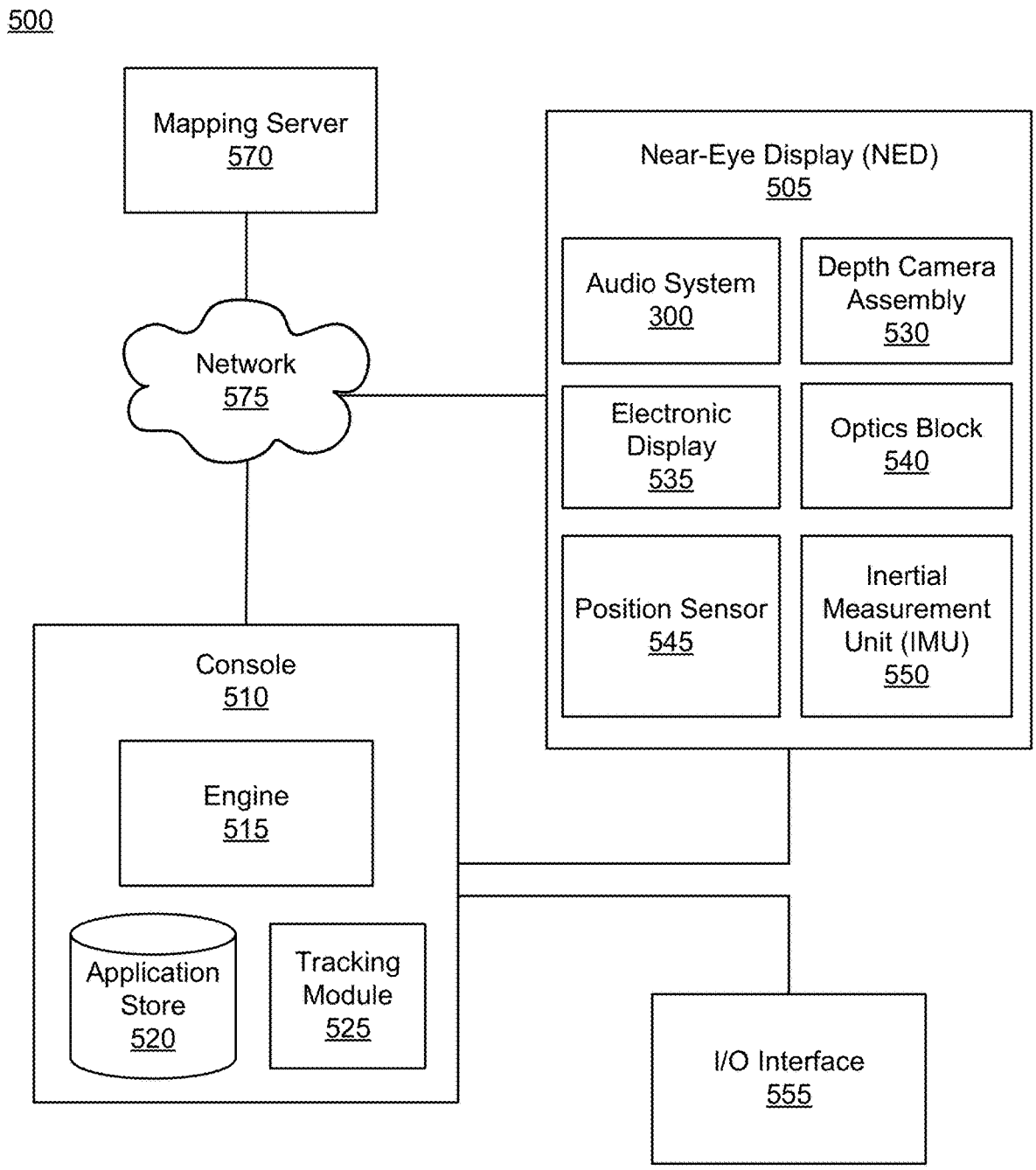
FIG. 5 is a block diagram of an example artificial reality system, in accordance with one or more embodiments.

FIG. 5 is a block diagram of an example artificial reality system 500, in accordance with one or more embodiments. The artificial reality system 500 presents an artificial reality environment to a user, e.g., a virtual reality, an augmented reality, a mixed reality environment, or some combination thereof. The system 500 comprises a near eye display (NED) 505, which may include a headset and/or a head mounted display (HMD), and an input/output (I/O) interface 555, both of which are coupled to a console 510. The system 500 also includes a mapping server 570 which couples to a network 575. The network 575 couples to the NED 505 and the console 510. The NED 505 may be an embodiment of the headset 100. While FIG. 5 shows an example system with one NED, one console, and one I/O interface, in other embodiments, any number of these components may be included in the system 500.

The NED 505 presents content to a user comprising augmented views of a physical, real-world environment with computer-generated elements (e.g., two dimensional (2D) or three dimensional (3D) images, 2D or 3D video, sound, etc.). The NED 505 may be an eyewear device or a head-mounted display. In some embodiments, the presented content includes audio content that is presented via the audio system 300 that receives audio information (e.g., an audio signal) from the NED 505, the console 610, or both, and presents audio content based on the audio information. The NED 505 presents artificial reality content to the user. The NED includes the audio system 300, a depth camera assembly (DCA) 530, an electronic display 535, an optics block 540, one or more position sensors 545, and an inertial measurement unit (IMU) 550. The position sensors 545 and the IMU 550 are embodiments of the sensors 140A-B. In some embodiments, the NED 505 includes components different from those described here. Additionally, the functionality of various components may be distributed differently than what is described here.

The audio system 300 provides audio content to the user of the NED 505. As described above, with reference to FIGS. 1-4, the audio system 300 renders audio content for a target artificial reality environment. A sensor array 310 captured audio content, which a controller 330 analyzes for acoustic properties of an environment. Using the environment's acoustic properties and a set of target acoustic properties for the target environment, the controller 330 determines a transfer function. The transfer function is convolved with the detected audio content, resulting in adjusted audio content having at least some of the acoustic properties of the target environment. A speaker array 320 presents the adjusted audio content to the user, presenting sound as if it were being transmitted in the target environment.

The DCA 530 captures data describing depth information of a local environment surrounding some or all of the NED 505. The DCA 530 may include a light generator (e.g., structured light and/or a flash for time-of-flight), an imaging device, and a DCA controller that may be coupled to both the light generator and the imaging device. The light generator illuminates a local area with illumination light, e.g., in accordance with emission instructions generated by the DCA controller. The DCA controller is configured to control, based on the emission instructions, operation of certain components of the light generator, e.g., to adjust an intensity and a pattern of the illumination light illuminating the local area. In some embodiments, the illumination light may include a structured light pattern, e.g., dot pattern, line pattern, etc. The imaging device captures one or more images of one or more objects in the local area illuminated with the illumination light. The DCA 530 can compute the depth information using the data captured by the imaging device or the DCA 530 can send this information to another device such as the console 510 that can determine the depth information using the data from the DCA 530.

In some embodiments, the audio system 300 may utilize the depth information obtained from the DCA 530. The audio system 300 may use the depth information to identify directions of one or more potential sound sources, depth of one or more sound sources, movement of one or more sound sources, sound activity around one or more sound sources, or any combination thereof. In some embodiments, the audio system 300 may use the depth information from the DCA 530 to determine acoustic parameters of the environment of the user.

The electronic display 535 displays 2D or 3D images to the user in accordance with data received from the console 510. In various embodiments, the electronic display 535 comprises a single electronic display or multiple electronic displays (e.g., a display for each eye of a user). Examples of the electronic display 535 include: a liquid crystal display (LCD), an organic light emitting diode (OLED) display, an active-matrix organic light-emitting diode display (AMOLED), waveguide display, some other display, or some combination thereof. In some embodiments, the electronic display 545 displays visual content associated with audio content presented by the audio system 300. When the audio system 300 presents audio content adjusted to sound as though it were presented in the target environment, the electronic display 535 may present to the user visual content that depicts the target environment.

In some embodiments, the optics block 540 magnifies image light received from the electronic display 535, corrects optical errors associated with the image light, and presents the corrected image light to a user of the NED 505. In various embodiments, the optics block 540 includes one or more optical elements. Example optical elements included in the optics block 540 include: a waveguide, an aperture, a Fresnel lens, a convex lens, a concave lens, a filter, a reflecting surface, or any other suitable optical element that affects image light. Moreover, the optics block 540 may include combinations of different optical elements. In some embodiments, one or more of the optical elements in the optics block 540 may have one or more coatings, such as partially reflective or anti-reflective coatings.

Magnification and focusing of the image light by the optics block 540 allows the electronic display 535 to be physically smaller, weigh less, and consume less power than larger displays. Additionally, magnification may increase the field of view of the content presented by the electronic display 535. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 540 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 535 for display is predistorted, and the optics block 540 corrects the distortion when it receives image light from the electronic display 535 generated based on the content.

The IMU 550 is an electronic device that generates data indicating a position of the headset 505 based on measurement signals received from one or more of the position sensors 545. A position sensor 545 generates one or more measurement signals in response to motion of the headset 505. Examples of position sensors 545 include: one or more accelerometers, one or more gyroscopes, one or more magnetometers, another suitable type of sensor that detects motion, a type of sensor used for error correction of the IMU 550, or some combination thereof. The position sensors 545 may be located external to the IMU 550, internal to the IMU 550, or some combination thereof. In one or more embodiments, the IMU 550 and/or the position sensor 545 may be sensors in the sensor array 420, configured to capture data about the audio content presented by audio system 300.

Based on the one or more measurement signals from one or more position sensors 545, the IMU 550 generates data indicating an estimated current position of the NED 505 relative to an initial position of the NED 505. For example, the position sensors 545 include multiple accelerometers to measure translational motion (forward/back, up/down, left/right) and multiple gyroscopes to measure rotational motion (e.g., pitch, yaw, and roll). In some embodiments, the IMU 550 rapidly samples the measurement signals and calculates the estimated current position of the NED 505 from the sampled data. For example, the IMU 550 integrates the measurement signals received from the accelerometers over time to estimate a velocity vector and integrates the velocity vector over time to determine an estimated current position of a reference point on the NED 505. Alternatively, the IMU 550 provides the sampled measurement signals to the console 510, which interprets the data to reduce error. The reference point is a point that may be used to describe the position of the NED 505. The reference point may generally be defined as a point in space or a position related to the eyewear device's 505 orientation and position.

The I/O interface 555 is a device that allows a user to send action requests and receive responses from the console 510. An action request is a request to perform a particular action. For example, an action request may be an instruction to start or end capture of image or video data, or an instruction to perform a particular action within an application. The I/O interface 555 may include one or more input devices. Example input devices include: a keyboard, a mouse, a hand controller, or any other suitable device for receiving action requests and communicating the action requests to the console 510. An action request received by the I/O interface 555 is communicated to the console 510, which performs an action corresponding to the action request. In some embodiments, the I/O interface 515 includes an IMU 550, as further described above, that captures calibration data indicating an estimated position of the I/O interface 555 relative to an initial position of the I/O interface 555. In some embodiments, the I/O interface 555 may provide haptic feedback to the user in accordance with instructions received from the console 510. For example, haptic feedback is provided when an action request is received, or the console 510 communicates instructions to the I/O interface 555 causing the I/O interface 555 to generate haptic feedback when the console 510 performs an action. The I/O interface 555 may monitor one or more input responses from the user for use in determining a perceived origin direction and/or perceived origin location of audio content.

The console 510 provides content to the NED 505 for processing in accordance with information received from one or more of: the NED 505 and the I/O interface 555. In the example shown in FIG. 5, the console 510 includes an application store 520, a tracking module 525 and an engine 515. Some embodiments of the console 510 have different modules or components than those described in conjunction with FIG. 5. Similarly, the functions further described below may be distributed among components of the console 510 in a different manner than described in conjunction with FIG. 5.

The application store 520 stores one or more applications for execution by the console 510. An application is a group of instructions, that when executed by a processor, generates content for presentation to the user. Content generated by an application may be in response to inputs received from the user via movement of the NED 505 or the I/O interface 555. Examples of applications include: gaming applications, conferencing applications, video playback applications, or other suitable applications.

The tracking module 525 calibrates the system environment 500 using one or more calibration parameters and may adjust one or more calibration parameters to reduce error in determination of the position of the NED 505 or of the I/O interface 555. Calibration performed by the tracking module 525 also accounts for information received from the IMU 550 in the NED 505 and/or an IMU 550 included in the I/O interface 555. Additionally, if tracking of the NED 505 is lost, the tracking module 525 may re-calibrate some or all of the system environment 500.

The tracking module 525 tracks movements of the NED 505 or of the I/O interface 555 using information from the one or more position sensors 545, the IMU 550, the DCA 530, or some combination thereof. For example, the tracking module 525 determines a position of a reference point of the NED 505 in a mapping of a local area based on information from the NED 505. The tracking module 525 may also determine positions of the reference point of the NED 505 or a reference point of the I/O interface 555 using data indicating a position of the NED 505 from the IMU 550 or using data indicating a position of the I/O interface 555 from an IMU 550 included in the I/O interface 555, respectively. Additionally, in some embodiments, the tracking module 525 may use portions of data indicating a position or the headset 505 from the IMU 550 to predict a future position of the NED 505. The tracking module 525 provides the estimated or predicted future position of the NED 505 or the I/O interface 555 to the engine 515. In some embodiments, the tracking module 525 may provide tracking information to the audio system 300 for use in generating the sound filters.

The engine 515 also executes applications within the system environment 500 and receives position information, acceleration information, velocity information, predicted future positions, or some combination thereof, of the NED 505 from the tracking module 525. Based on the received information, the engine 515 determines content to provide to the NED 505 for presentation to the user. For example, if the received information indicates that the user has looked to the left, the engine 515 generates content for the NED 505 that mirrors the user's movement in a virtual environment or in an environment augmenting the local area with additional content. Additionally, the engine 515 performs an action within an application executing on the console 510 in response to an action request received from the I/O interface 555 and provides feedback to the user that the action was performed. The provided feedback may be visual or audible feedback via the NED 505 or haptic feedback via the I/O interface 555.

The mapping server 570 may provide the NED 505 with audio and visual content to present to the user. The mapping server 570 includes a database that stores a virtual model describing a plurality of environments and acoustic properties of those environments, including a plurality of target environments and their associated acoustic properties. The NED 505 may query the mapping server 570 for the acoustic properties of an environment. The mapping server 570 receives, from the NED 505, via the network 575, visual information describing at least the portion of the environment the user is currently in, such as a room, and/or location information of the NED 505. The mapping server 570 determines, based on the received visual information and/or location information, a location in the virtual model that is associated with the current configuration of the room. The mapping server 570 determines (e.g., retrieves) a set of acoustic parameters associated with the current configuration of the room, based in part on the determined location in the virtual model and any acoustic parameters associated with the determined location. The mapping server 570 may also receive information about a target environment that the user wants to simulate via the NED 505. The mapping server 570 determines (e.g., retrieves) a set of acoustic parameters associated with the target environment. The mapping server 570 may provide information about the set of acoustic parameters, about the user's current environment and/or the target environment, to the NED 505 (e.g., via the network 575) for generating audio content at the NED 505. Alternatively, the mapping server 570 may generate an audio signal using the set of acoustic parameters and provide the audio signal to the NED 505 for rendering. In some embodiments, some of the components of the mapping server 570 may be integrated with another device (e.g., the console 510) connected to NED 505 via a wired connection.

The network 575 connects the NED 505 to the mapping server 570. The network 575 may include any combination of local area and/or wide area networks using both wireless and/or wired communication systems. For example, the network 575 may include the Internet, as well as mobile telephone networks. In one embodiment, the network 575 uses standard communications technologies and/or protocols. Hence, the network 575 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 575 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 575 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc. The network 575 may also connect multiple headsets located in the same or different rooms to the same mapping server 570. The use of mapping servers and networks to provide audio and visual content is described in further detail in U.S. patent application Ser. No. 16/366,484 filed on Mar. 27, 2019, incorporated herein by reference in its entirety.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like, in relation to manufacturing processes. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described (e.g., in relation to manufacturing processes.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

analyzing sound in an environment to identify a set of acoustic properties associated with the environment;

receiving audio content generated within the environment;

determining a transfer function based on a comparison of the set of acoustic properties to a set of target acoustic properties for a target environment;

adjusting the audio content using the transfer function, wherein the transfer function adjusts the set of acoustic properties of the audio content based on the set of target acoustic properties for the target environment; and presenting the adjusted audio content for the user, wherein the adjusted audio content is perceived by the user to have been generated in the target environment.

2. The method of claim 1, wherein adjusting the audio content using the transfer function further comprises:

identifying ambient sound in the environment; and filtering the ambient sound out of the adjusted audio content for the user.

3. The method of claim 1, further comprising:

providing the user with a plurality of target environment options, each of the plurality of target environment options corresponding to a different target environment; and receiving, from the user, a selection of the target environment from the plurality of target environment options.

4. The method of claim 3, wherein each of the plurality of target environment options is associated with a different set of acoustic properties for the target environment.

5. The method of claim 1, further comprising:

determining an original response characterizing the set of acoustic properties associated with the environment; and determining a target response characterizing the set of target acoustic properties for the target environment.

6. The method of claim 5, wherein determining the transfer function further comprises:

comparing the original response and the target response; and determining, based on the comparison, differences between the set of acoustic parameters associated with the environment and the set of acoustic parameters associated with the target environment.

7. The method of claim 1, further comprising:

generating sound filters using the transfer function, wherein the adjusted audio content is based in part on the sound filters.

8. The method of claim 1, wherein determining the transfer function is determined based on at least one previously measured room impulse or algorithmic reverberation.

9. The method of claim 1, wherein adjusting the audio content further comprises:

convolving the transfer function with the received audio content.

10. The method of claim 1, wherein the received audio content is generated by at least one user of a plurality of users.

11. An audio system comprising:

one or more sensors configured to receive audio content within an environment;

one or more speakers configured to present audio content to a user; and a controller configured to:

analyze sound in the environment to identify a set of acoustic properties associated with the environment;

determine a transfer function based on a comparison of the set of acoustic properties to a set of target acoustic properties for a target environment;

adjust the audio content using the transfer function, wherein the transfer function adjusts the set of acoustic properties of the audio content based on the set of target acoustic properties for the target environment; and instruct the speaker to present the adjusted audio content to the user, wherein the adjusted audio content is perceived by the user to have been generated in the target environment.

12. The system of claim 11, wherein the audio system is part of a headset.

13. The system of claim 11, wherein adjusting the audio content further comprises:

identifying ambient sound in the environment; and filtering the ambient sound out of the adjusted audio content for the user.

14. The system of claim 11, wherein the controller is further configured to:

provide the user with a plurality of target environment options, each of the plurality of target environment options corresponding to a different target environment; and receive, from the user, a selection of the target environment from the plurality of target environment options.

15. The system of claim 14, wherein each of the plurality of target environment options is associated with a set of target acoustic properties for the target environment.

16. The system of claim 11, wherein the controller is further configured to:

determine an original response characterizing the set of acoustic properties associated with the environment; and determine a target response characterizing the set of target acoustic properties for the target environment.

17. The system of claim 16, wherein the controller is further configured to:

estimate a room impulse response of the environment, wherein the room impulse response is used to generate the original response.

18. The system of claim 11, wherein the controller is further configured to:

generate sound filters using the transfer function; and adjust the audio content based in part on the sound filters.

19. The system of claim 11, wherein the controller is further configured to:

determine the transfer function using at least one previously measured room impulse response or algorithmic reverberation.

20. The system of claim 11, wherein the controller is configured to adjust the audio content by convolving the transfer function with the received audio content.

* * * * *